US010500755B2

(12) United States Patent
Yu et al.

(10) Patent No.: US 10,500,755 B2
(45) Date of Patent: Dec. 10, 2019

(54) DISPOSABLE WOODWORKING TOOL

(71) Applicant: Rikon Power Tools, Inc., Billerica, MA (US)

(72) Inventors: Lihe Yu, Shandong (CN); Jiquan Jiang, Shandong (CN); Junchao Xu, Shandong (CN); Yanqiang Qu, Shandong (CN)

(73) Assignee: Rikon Power Tools, Inc., Billerica, MA (US)

( * ) Notice: Subject to any disclaimer, the term of this patent is extended or adjusted under 35 U.S.C. 154(b) by 0 days.

(21) Appl. No.: 15/800,336

(22) Filed: Nov. 1, 2017

(65) Prior Publication Data

US 2018/0178404 A1 Jun. 28, 2018

(30) Foreign Application Priority Data

Dec. 23, 2016 (CN) ..... 2016 1 1204927
Dec. 23, 2016 (CN) ..... 2016 2 1424485 U

(51) Int. Cl.
*B27G 15/00* (2006.01)

(52) U.S. Cl.
CPC ..... *B27G 15/00* (2013.01)

(58) Field of Classification Search
CPC ..... B27G 15/00
USPC ..... 142/56
See application file for complete search history.

(56) References Cited

U.S. PATENT DOCUMENTS 4,754,787 A * 7/1988 Smith ..... B27G 15/00 142/56
4,924,924 A * 5/1990 Stewart ..... B27C 7/06 142/36
9,079,327 B2 * 7/2015 Proctor ..... B23B 27/02
2012/0006448 A1 * 1/2012 Batty ..... B27G 15/00 142/56

FOREIGN PATENT DOCUMENTS

CN 202 447 692 U 9/2012
CN 203 390 226 U 1/2014
CN 204 158 522 U 2/2015
(Continued)

OTHER PUBLICATIONS

Chinese Office Action and First Search for Chinese Application No. 201611204927.2 dated Jun. 4, 2018.
(Continued)

*Primary Examiner* — Alan Snyder
(74) *Attorney, Agent, or Firm* — Jenkins, Wilson, Taylor & Hunt, P.A.

(57) ABSTRACT

A disposable woodworking tool includes a cutter bar and a locking piece, the front end of the cutter bar installed with a cutting head, while the tail end of the cutter bar is installed with a connecting long sleeve. The tail end of the cutter bar includes a tail end installation part fixedly connected with the connecting long sleeve via a locking piece in a detachable manner. The cutter bar includes planes along the length direction extending to the position, where the cutting head is installed, on the front end of the cutter bar, and the locking piece utilizes the principle of a spring collet. In use, instant switching of the angle of the cutting head can occur through switching of planes, without a tool. Rapid replacement of the cutter bar can occur.

9 Claims, 9 Drawing Sheets

(56) References Cited

FOREIGN PATENT DOCUMENTS

| | | | | | |
|---|---|---|---|---|---|
| CN | 204 640 413 | U | | 9/2015 | |
| CN | 206 367 059 | U | | 8/2017 | |
| EP | 0775042 | A4 | | 5/1999 | |
| EP | 0775042 | B1 | | 10/2001 | |
| FR | 1247636 | A | * | 12/1960 | ..... B25D 3/00 |
| GB | 2192825 | A | | 1/1988 | |
| GB | 2312640 | A | | 11/1997 | |

OTHER PUBLICATIONS

Chinese Office Action for Application No. 201611204927.2 dated Jan. 28, 2019.

* cited by examiner

DISPOSABLE WOODWORKING TOOL

CROSS-REFERENCE TO RELATED APPLICATIONS

This patent application claims priority to Chinese Patent Application No. 201611204927.2 and Chinese Patent Application No. 201621424485.8, both filed Dec. 23, 2016, the entire disclosures of which are incorporated by reference herein.

TECHNICAL FIELD

The subject matter herein relates generally to the field of wood working machines, and more particularly relates to a disposable woodworking tool capable of rapidly replacing a cutter bar and changing angles.

BACKGROUND ART

In woodworking machines, a tool of the woodworking lathe is a necessary turning tool. Woodworking workpieces are installed between the two thimbles of the woodworking lathe and are fastened. When a machine is started, the workpieces rotate, the tool is handheld and placed on the tool holder of the woodworking lathe, and then the workpieces are aligned to be grinded into parts of different shapes.

At present, multiple types of woodworking tools are available, such as serial woodworking tool combinations composed of multiple single tools and disposable woodworking tools. The serial woodworking tool combinations are complex in structure, the more sets they have, the more space they will occupy, then the grinded cutting edge will have the defects of uneven height and edge chipping, thereby influencing the quality of the processed surface, while the disposable woodworking tool is a tool with replaceable cutting head, when one position of the cutting head is blunt, the other position can be used continuously, after all the positions of the cutting head are blunt, a new cutting head can be replaced, and the cutting head does not need to be grinded for repeated use. Due to its features of convenient processing and high precision of the processing surface, the disposable woodworking tool is promoted and used more widely.

FIG. 1 and FIG. 2 are structural schematic diagrams of the existing, conventional disposable woodworking tool. The existing disposable woodworking tool includes a connecting long sleeve 010, the two ends of the connecting long sleeve 010 are provided with internal threads, wherein one end is connected to a rear end cap 07 while the other end is installed with a connecting clamp 09; a circular connecting rod 06 is inserted into the connecting clamp 09, the connecting clamp 09 is installed with two fastening screws 08 to fix the connecting rod 06, the top end of the circular connecting rod 06 is installed with a cutting head holder 03, the cutting head holder 03 is provided with a cutting head 01 via a screw 02, the tool holder cover 05 fastens the cutting head holder 03 onto the circular connecting rod 06; three small notches are processed on the top end of the circular connecting rod 06 along the circumference, the cutting head holder 03 is further installed with a positioning screw 04 for adjusting the angle of the cutting head holder 03.

If the angle of the cutting head needs to be switched in the using process, the tool holder cover 05 needs to be loosened, corresponding small notches are aligned with the positioning screws 04, then the tool holder cover 05 is fastened, so as to change the three different angles of the cutting head 01; if the connecting rod 06 needs to be replaced, the fastening screw 08 needs to be loosened with a tool, the circular connecting rod 06 with a plane and with the tool holder and the cutting head is taken down, the connecting rod of another type of cutting head is replaced, and then the fastening screw 08 is tightened for use. During working, the tool is handheld, the upper surface of the connecting rod is in close contact with the surface of the tool holder configured and placed in the woodworking lathe, and then the turning operation can be conducted by moving or rotating the tool.

Since the requirement of woodworking processing on the processing efficiency and precision becomes higher and higher, it is difficult for the existing disposable tool to satisfy the use requirement on high efficiency and precision in the processing and using process, and the existing disposable tool has the following disadvantages: (1) it is troublesome to change the angle of the tool 01, as a tool holder cover 05 should be loosened, a cutting head holder 03 should be rotated to be aligned with the positioning screw 04, then the tool holder cover 05 is locked again, so the operation is tedious and wastes time and labor; (2) when a connecting rod 06 needs to be replaced, a fastening screw 08 needs to be twisted off with a tool, after replacement, the fastening screw needs to be inserted again and fastened, so the operation is tedious; and (3) as limited by the structure with an angle replacement function, the diameter of the structure of the tool holder cover 05 is larger than the connecting rod 06, then the top end of the circular connecting rod 06 is far away from the cutting head, so that when a workpiece is processed, the fulcrum of the connecting rod 06 is far away from the force-bearing point of the cutting head, then vibration is easy to produce, and the surface precision and processing range of the workpiece are influenced.

SUMMARY

Aiming at the defects that the processing precision and efficiency may be influenced by the complex structure and low efficiency of switching the angle of the cutting head of the existing woodworking tool, the technical problem to be solved by the present disclosure is to provide a disposable woodworking tool which can realize instant switching of the angle of the cutting head and improve the processing efficiency.

The present disclosure is realized by adopting the following technical solutions:

A disposable woodworking tool includes a cutter bar and a locking piece, wherein the front end of the cutter bar is installed with a cutting head, while the tail end of the cutter bar is installed with a connecting long sleeve, the cutter bar includes a tail end installation part which is fixedly connected with the connecting long sleeve via a locking piece in a detachable manner; the cutter bar is provided with a plurality of milling planes along the length direction of the cutter bar, the planes extend to the position, where the cutting head is installed, on the front end of the cutter bar. In the using process, if the angle of the cutting head needs to be switched, the instant switching of the angle of the cutting head can be realized only by handholding one of the planes and attaching the plane to a tool holder arranged in a woodworking lathe, therefore, the operation is convenient and rapid. Meanwhile, the planes extend to the position, where the cutting head is installed, on the front end of the cutter bar, the structural design of the plane enables a nearest distance between the fulcrum of the cutter bar and the force-bearing point of the cutting head, thereby realizing the requirement of stabilizing the tool, enlarging the processing range, and improving the processing precision.

Further, the planes include a first plane, a second plane and a third plane which are connected in sequence, wherein the second plane is a reference plane, and is in parallel with the upper surface of the cutting head, and the angle formed between the first plane and the second plane as well as the angle formed between the second plane and the third plane are both in a range of 130°-150°. When different planes are switched, the angle of the cutting head is also changed, thereby realizing the instant switching of the angle of the cutting head with no use of any tool and satisfying the requirement of different cutting angles.

Further, the tail end installation part is arranged eccentrically to the axis of the cutter bar, until the plane reaches its maximum width, such as when the eccentric distance is about 2.5 mm, the width of the plane is 8 mm to 9 mm, thereby not only broadening the plane, ensuring no interference with the tail end installation part, but also increasing the turning stability of the cutter bar.

Further, the locking piece includes a cutter bar locking external clamp and a cutter bar locking internal clamp which is connected with the cutter bar locking external clamp, an accommodation cavity for accommodating the tail end installation part is arranged along the axis of the locking piece; the cutter bar locking external clamp comprises a rotary twist part and an external cone, wherein the external cone includes clamping jaws capable of centering contraction, the cutter bar locking internal clamp comprises a fixed part and an internal cone which coordinates with the external cone, the fixed part is connected with the connecting long sleeve; the structure is designed in combination with the structure principle of a spring collet, when the cutter bar is rotated by hands to lock the external clamp, the clamping jaws of the external cone are subjected to centering contraction under the compression from the internal cone, thereby locking the cutter bar tail end installation part, otherwise, the cutter bar is loosened, thereby realizing rapid replacement of the cutter bar.

Further, the outer surface of the locking piece is provided with anti-slippery stripes, such as knurling treatment is adopted or an anti-slippery sleeve is added, so as to increase friction and facilitate rotary twist.

Further, a positioning piece which can prevent the axial rotation of the cutter bar is further arranged between the cutter bar and the locking piece, so as to position the cutter bar, prevent the axial rotation of the cutter bar, enhance the tightness and use effect of the cutter bar, effectively improve the turning precision, and effectively prolong the service life of the tool.

Further, the poisoning piece includes a positioning bulge and a positioning groove which is corresponding to the positioning bulge, wherein the positioning bulge and the positioning groove are arranged on the cutter bar and the locking piece, respectively, for example, for convenient processing, the positioning bulge can adopt a screw in threaded connection with the cutter bar and can be arranged on the front end of the tail end installation part, and the positioning groove is arranged on the inner edge of the front end of the cutter bar locking external clamp.

Further, the cutting head is installed at the front end of the cutter bar via a fastening screw, the cutting head can be replaced separately, and can also be replaced together with the cutter rod, therefore, the structural design is simple and the operation is convenient.

Further, the connecting long sleeve is sheathed with a rubber cartridge to increase the comfort of hand feeling, increase the friction, and improve the safe operation performance.

Further, the connecting long sleeve is internally provided with a counterweight cabin, the tail end of the connecting long sleeve is provided with an end cover, the counterweight cabin is internally provided with a counterweight block, and the end cover is provided with a threaded hole for installing the counterweight block.

Compared with the prior art, the disclosure herein has the following advantages and beneficial effects:

In the disposable woodworking tool of the subject matter herein, a plurality of surfaces are milled on the cutter bar according to a certain angle. In the using process, if the angle of the cutting head needs to be switched, instant and rapid switching of the angle can be realized only by handholding the corresponding surface and attaching the surface to the tool holder arranged in the woodworking lathe; meanwhile, through a creative design of the fixed manner of the cutter bar, the structural form of a spring collet is adopted, when the external clamp is locked under the rotation of hands, the clamping jaws of the external cone are subjected to centering contraction, thereby fastening the cutter bar, otherwise, the cutter bar is loosened, then rapid replacement of the cutter bar is realized.

Further, the outer surface of the locking piece is provided with an anti-slippery part, knurling treatment is adopted to increase the friction and facilitate rotary twist. To prevent the axial rotation of the cutter bar, positioning pieces which coordinate mutually are arranged on the cutter bar and the locking piece, so as to enhance the tightness and use effect of the cutter bar, and effectively increase the turning precision and prolong the service life of the tool. In the process of processing the parts, the user can prepare three or more cutter bars installed with different shapes of cutter bars for standby use, and then the cutting head and the cutter bar can be replaced rapidly when a kind of tool is used in operation, so that the operation is smoother and saves more time.

Three planes are designed on the circular cutter bar based on a certain angle, the planes extend to the position, where the cutting head is installed, on the front end of the cutter bar, the length of the planes can also run through the entire cutter bar, so that the distance between the force-bearing point of the cutting head and the fulcrum of the cutter bar is only several millimeters, thereby enabling a nearest distance between the force-bearing point of the cutting head and the fulcrum of the cutter bar, realizing the requirement of stabilizing the tool, effectively enlarging the processing range, and improving the processing precision. The structural design of the woodworking tool in the disclosure herein is simple with low cost, the cutter bar can be rapidly replaced, the angle can be switched rapidly, and the operation becomes more smooth, convenient and stable.

DETAILED DESCRIPTION

In order to more clearly understand the above objectives, features and advantages of the disclosure herein, the disclosure herein will be further described below in combination with the example drawings described briefly above and the embodiments herein. As to the positional relationship between the front end and the tail end in the present embodiment, the end which is installed with a cutting head is taken as a front end, while the other end is taken as a tail end; in the following description, specific details are illustrated to fully understand the disclosure herein, however, the disclosure herein can also be implemented in other ways different from those described herein, therefore, the disclosure herein is not limited to the specific embodiments disclosed below.

Figure 1:
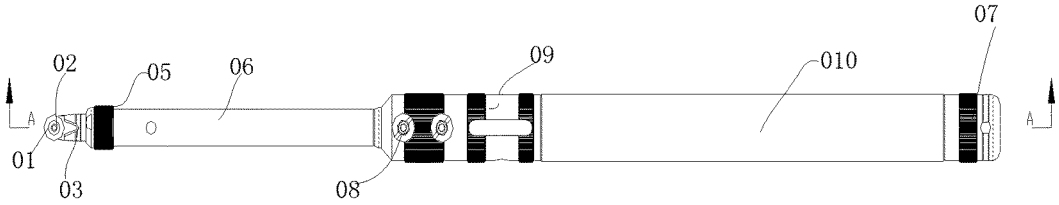
Fig. 1 (Prior Art)
FIG. 1 is a structural schematic diagram of an existing woodworking tool.
Figure 2:
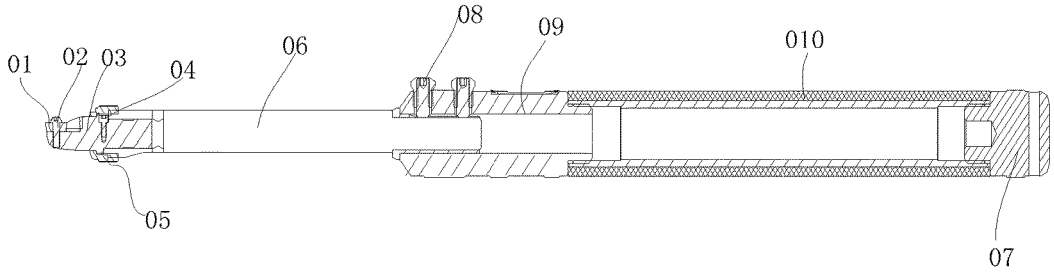
Fig. 2 (Prior Art)
FIG. 2 is a sectional schematic diagram of the woodworking tool in FIG. 1 in A-A direction.
Figure 3:
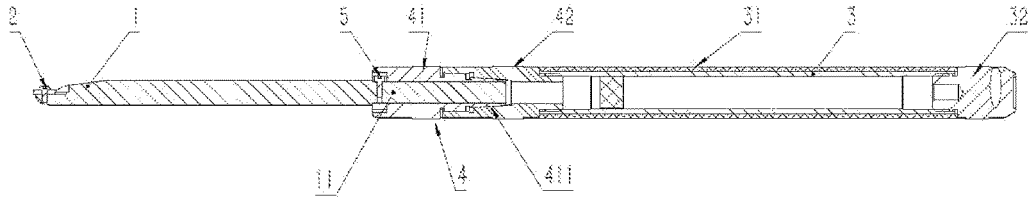
FIG. 3 is a structural schematic diagram of the woodworking tool in an embodiment of the subject matter herein.
Figure 4:
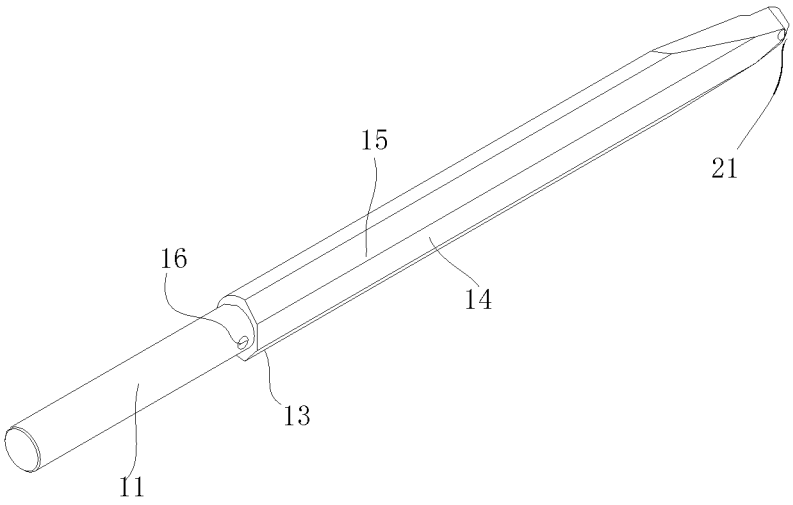
FIG. 4 is a structural schematic diagram of the cutter bar in FIG. 3.
Figure 5:
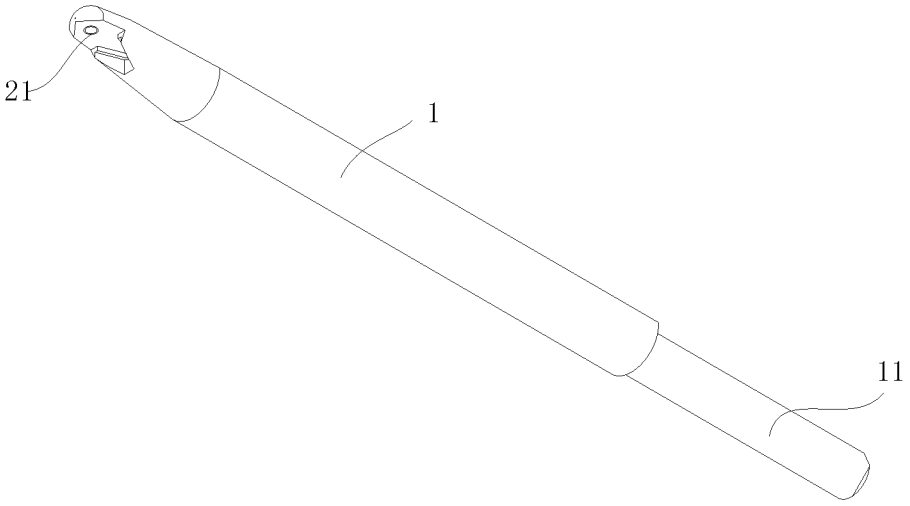
FIG. 5 is a structural schematic diagram of a viewing angle of the opposite surface of the cutter bar shown in FIG. 4.
Figure 6:
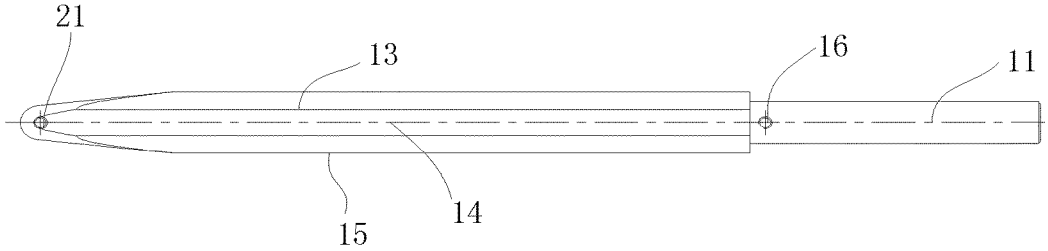
FIG. 6 is a structural schematic diagram of the cutter bar provided with three planes in an embodiment of the subject matter herein.
Figure 7:
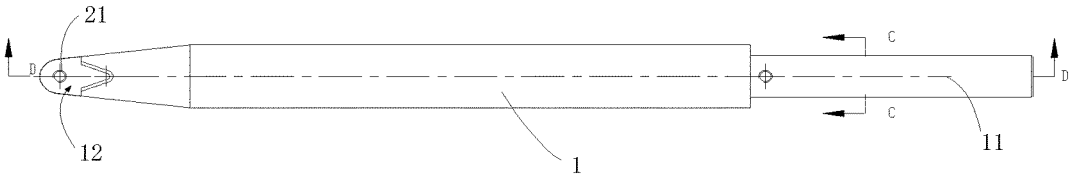
FIG. 7 is a structural schematic diagram of a viewing angle of the opposite surface of the cutter bar shown in FIG. 6.

With FIG. 3 as a reference, the embodiment provides a disposable woodworking tool which includes a cutter bar 1 and a locking piece 4, wherein the front end of the cutter bar is installed with a cutting head 2, and the tail end of the cutter bar 1 is installed with a connecting long sleeve 3, the cutter bar further includes a tail end installation part 11 which is fixedly connected with the connecting long sleeve 3 via the locking piece 4 in a detachable manner; refer to FIG. 4 to FIG. 5, a plurality of planes (13, 14, 15) are arranged on the cutter bar 1 along the length direction of the cutter bar 1, the planes extend to the position 12, where the cutting head is installed, on the front end of the cutter bar, in the using process, if the angle of the cutting head 2 needs to be switched, the instant switching of the angle of the cutting head 2 can be realized only by handholding one of the planes and attaching the plane to a tool holder arranged in a woodworking lathe, therefore, the operation is convenient and rapid. Meanwhile, the planes extend to the position 12, where the cutting head is installed on the front end of the cutter bar, the structural design of the plane enables a nearest distance between the fulcrum of the cutter bar and the force-bearing point of the cutting head, thereby realizing the requirement of stabilizing the tool, enlarging the processing range, and improving the processing precision.

In the present embodiment, the length of the plane runs through the entire cutter bar 11. Refer to FIG. 6 through FIG. 9, the front end of the planes extend to the position 12, where the cutting head is installed, on the front end of the cutter bar, while the tail end of the planes extend to the tail end of the cutter bar, so that the operation is convenient. For example, the planes in the present embodiment are preferably 3, which include a first plane 13, a second plane 14 and a third plane 15 which are connected in sequence, and the angle a formed between the first plane 13 and the second plane 14 as well as the angle a formed between the second plane and the third plane are both in a range of 130°-150°, and the angle a in the present embodiment is preferably 141°. In these three planes, the second plane is a reference plane and is also the most commonly used plane. The second plane is in parallel with the upper surface of the cutting head, and is also in parallel with the busbar on the surface of the workpiece, the switching of the angle means the change of the anterior angle of the tool, which plays a significant role in fine grinding of the curved surface of the workpiece. Of course, the number of the planes can also be six, the angle formed between each plane is 120°, and the change in the setting forms and angles of other multiple planes also cannot be excluded in terms of ensuring operation stability and high turning precision.

Figure 8:
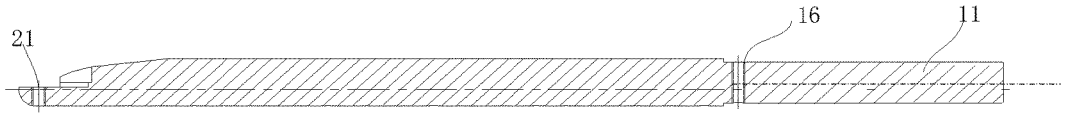
FIG. 8 is a sectional schematic diagram of D-D direction in FIG. 7.
Figure 9:
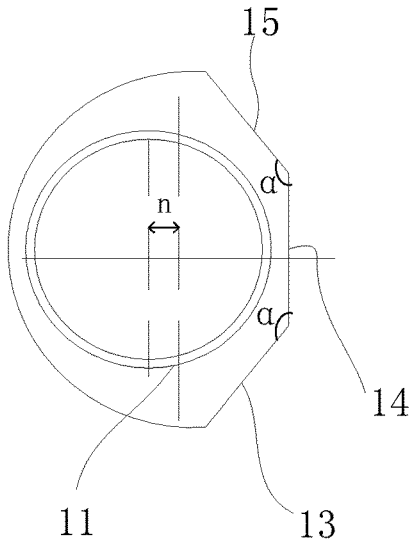
FIG. 9 is a sectional schematic diagram of C-C direction in FIG. 7.
Figure 10:
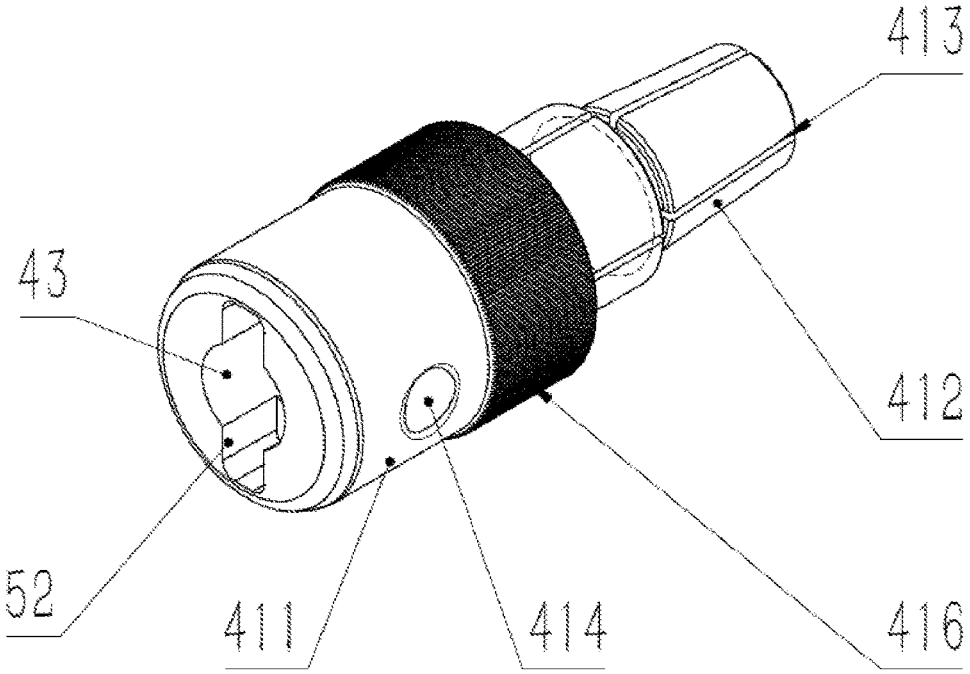
FIG. 10 is a schematic diagram of the three-dimensional structure of the cutter bar locking external clamp in an embodiment of the disclosure herein.
Figure 11:
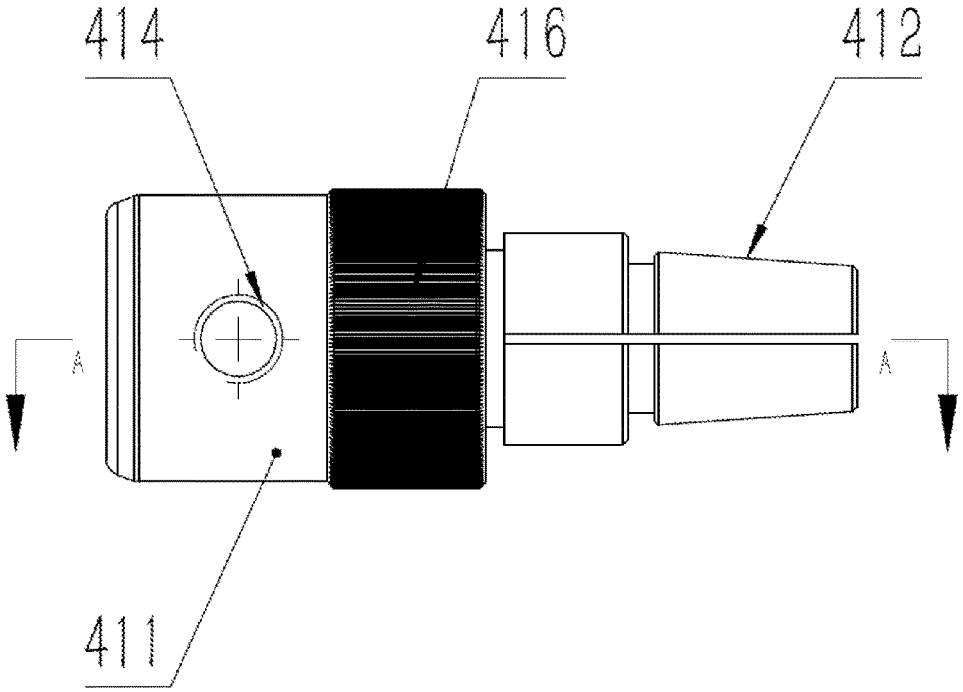
FIG. 11 is a main-view structural schematic diagram of the cutter bar locking external clamp in FIG. 10.
Figure 12:
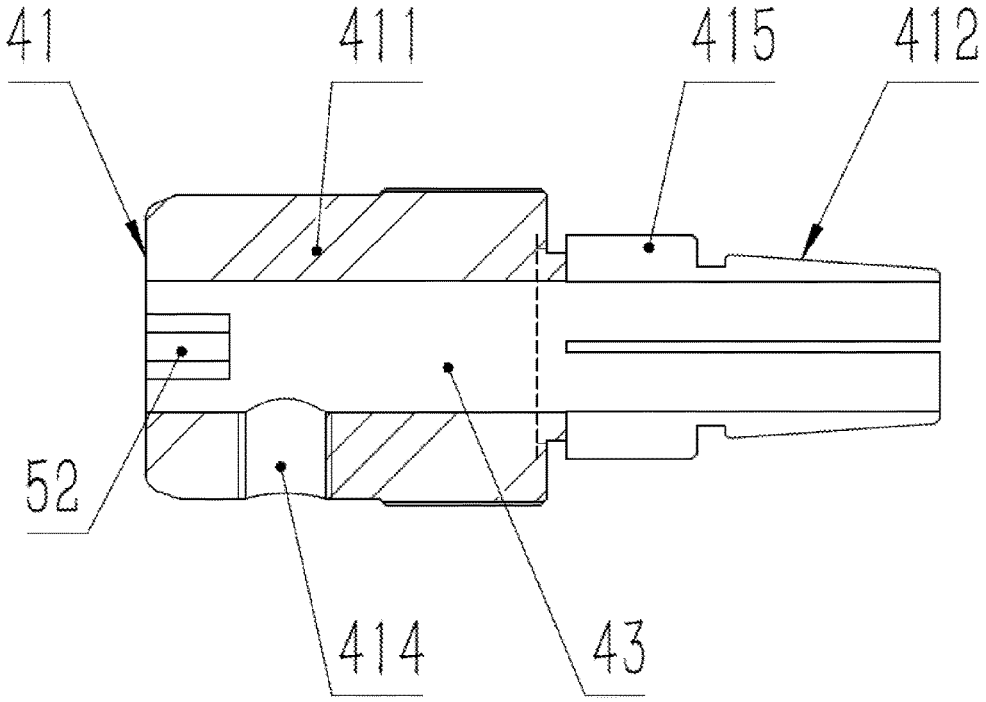
FIG. 12 is a sectional schematic diagram of the cutter bar locking external clamp in FIG. 11 in A'-A' direction.
Figure 13:
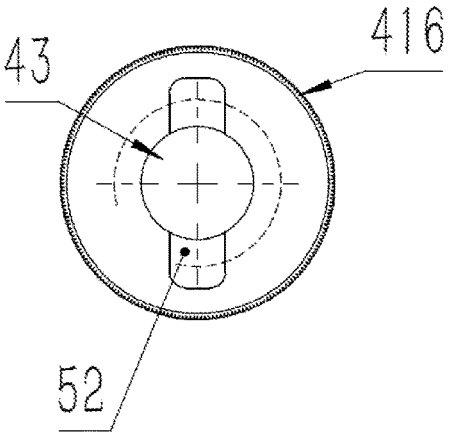
FIG. 13 is a left view of the cutter bar locking external clamp.
Figure 14:
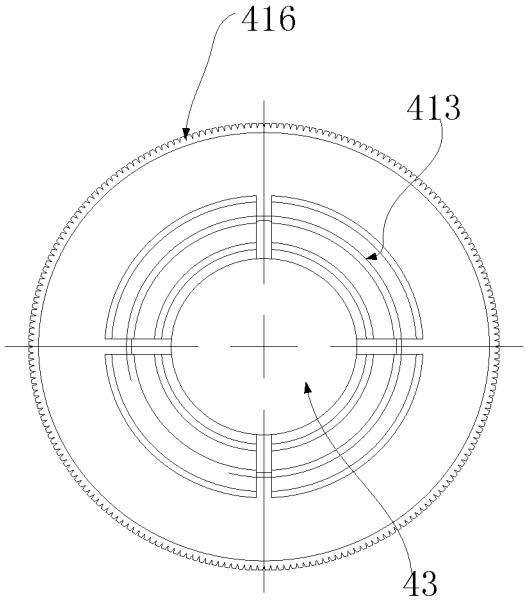
FIG. 14 is a right view of the cutter bar locking external clamp.

In the present embodiment, the tail end installation part 11 is set eccentrically to the axis of the cutter bar 1, ensuring no interference with the tail end installation part and increasing the turning stability of the cutter bar. Refer to FIGS. 8 and 9, the design is improved in the present embodiment after repeated experiments, whether the tail end installation part 11 should be eccentric to the axis of the cutter bar 1 has been verified for many times. When the diameter of the cutter bar 1 is constant, the width of the three planes is of the maximum value when the formed angle is 141°, and the width of the plane is 8 mm to 9 mm, thereby increasing the stability of the tool. In order to widen the planes without interfering the tail end installation part 11 to avoid influencing the operation, the tail end installation part 11 should be set to be eccentric to the axis of the cutter bar 1 by 2.5 mm, then a space for milling the planes is reserved, thereby realizing the objective that the width is large after the planes are milled and achieving better turning precision. When different planes are switched, the angle of the cutting head is also switched, thereby realizing instant switching of the angle of the cutting head with no use of any tool and satisfying the requirement on different turning angles.

Figure 15:
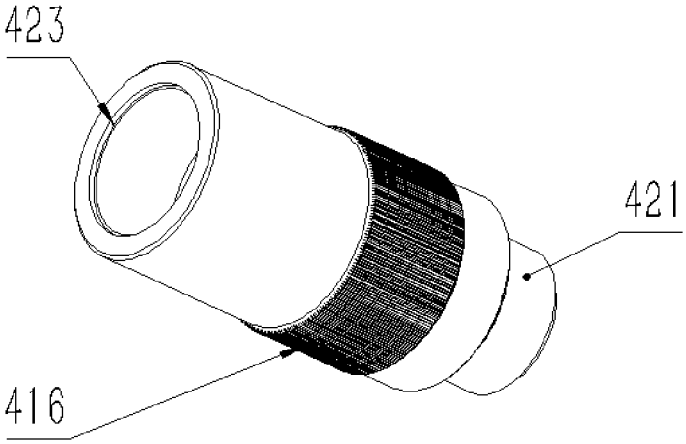
FIG. 15 is a schematic diagram of the three-dimensional structure of the cutter bar locking internal clamp in an embodiment of the subject matter herein.
Figure 16:
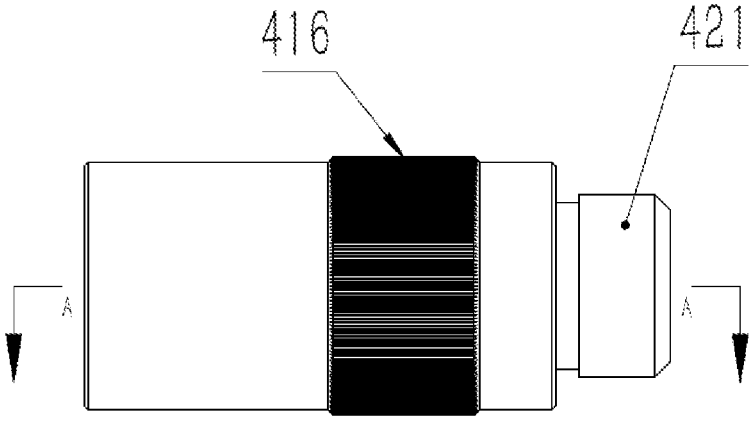
FIG. 16 a main-view structural schematic diagram of the cutter bar locking internal clamp in FIG. 15.
Figure 17:
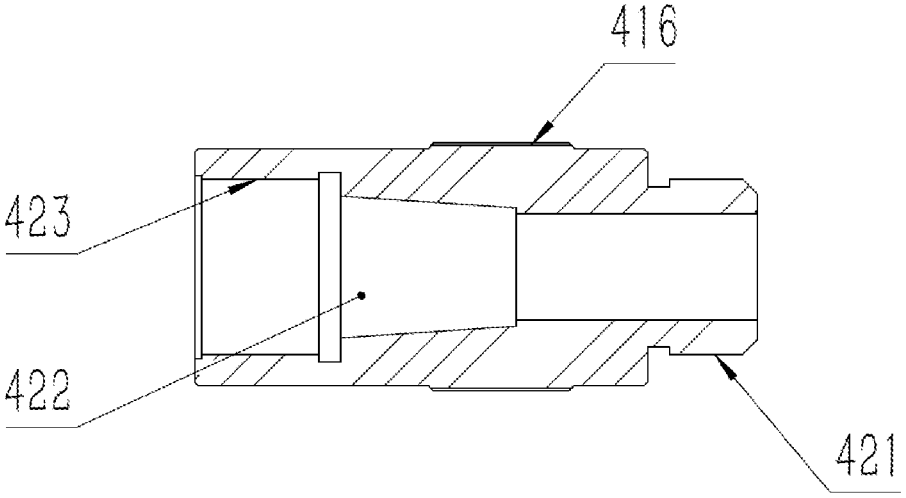
FIG. 17 is a sectional schematic diagram of the B-B' direction in FIG. 16.

Preferably, the locking piece 4 includes a cutter bar locking external clamp 41 and a cutter bar locking internal clamp 42 which is connected with the cutter bar locking external clamp 41, and as to the connecting mode, a threaded connection mode is adopted, namely, an internal thread 423, which is in match with the external thread 415 of the cutter bar locking external clamp 41, is arranged at one end of the cutter bar locking internal clamp 42; a fixed part 421 on the other end is provided with an external thread in match with the internal thread of the connecting long sleeve 3, and an accommodation cavity 43 for accommodating the tail end installation part 11 is arranged along the axis of the locking piece 4; refer to FIG. 10 through FIG. 14, the cutter bar locking external clamp 41 includes a rotary twist part 411 and an external cone 412, wherein the external cone 412 includes clamping jaws 413 capable of centering contraction, the clamping jaws 413 are formed after the external cone 412 is cut open, and the number of the clamping jaws in the present embodiment is four. Refer to FIG. 15 through FIG. 17, the cutter bar locking internal clamp 42 includes a fixed part 421 and an internal cone 422 which cooperates with the external cone 412, and the fixed part 421 is connected with the connecting long sleeve 3 via a thread; the structure of the locking piece 4 adopts the structural principle form similar to that of a spring collet, when the rotary twist part 411 of the cutter bar locking external clamp 41 is rotated with hands, the clamping jaws 413 of the external cone 412 are subjected to centering contraction, so as to fasten the tail end installation part 11 of the cutter bar, otherwise, the cutter bar 1 is loosened, thereby realizing rapid replacement of the cutter bar 1. In the process of processing parts, the user can prepare three or more cutter bars installed with different shapes of cutter bars for standby use, and then the cutting head and the cutter bar can be replaced rapidly when a kind of tool is used in operation, so that the operation is smoother and saves more time.

In order to facilitate the assembly and disassembly of the cutter bar 1, an anti-slippery part is arranged on the outer surface of the locking piece 4, namely, anti-slippery stripes 416 are arranged outside the cutter bar locking external clamp 41 and the cutter bar locking internal clamp 42, such as the adoption of knurling treatment or the addition of an anti-slippery sleeve, so as to increase friction and facilitate rotary twist.

In addition, in order to enhance the tightness and use effect of the cutter bar 1 and prevent the axial rotation of the cutter bar 1, a positioning piece 5 for preventing the axial rotation of the cutter bar 1 is further arranged between the cutter bar 1 and the locking piece 4, so as to effectively increase the turning precision and prolong the service life of the tool. The positioning piece 5 in the present embodiment includes a positioning bulge and a positioning groove 52 which is corresponding to the positioning bulge, the positioning bulge and the positioning groove 52 are arranged on the inner wall of the edge of the front end of the cutter bar tail end installation part 11 and the inner wall of the edge of the front end of the cutter bar locking external clamp 41, respectively, and the specific positional relationship can be set with reference to the position relationship indicated by the reference number 5 in FIG. 3, reference number 16 in FIG. 4 and reference number 52 in FIG. 10. Of course, the set position of the positioning bulge and the positioning groove 52 can be exchanged, e.g., the positioning groove is formed on the cutter bar while the positioning bulge is arranged on the cutter bar locking external clamp, as long as the positioning can be realized. To facilitate processing, in the present embodiment, the positioning bulge adopts the form of a screw which is in threaded connection with the cutter bar, namely, a screw hole 16 is arranged on the front end of the tail end installation part 11 of the cutter bar, a pin can also be adopted, and a positioning groove 52 can be arranged on the inner wall of the edge of the front end of the cutter bar locking external clamp 41, of course, other forms can also be adopted and these will not be described in detail herein. In addition, the cutting head 2 is installed in a screw hole 21 on the front end of the cutter bar 1 via a fastening screw, the cutting head 2 can be replaced separately, or the cutter bar 1 and the cutting head 2 can also be replaced together, therefore, the structural design is simple and the operation is convenient.

Figure 18:
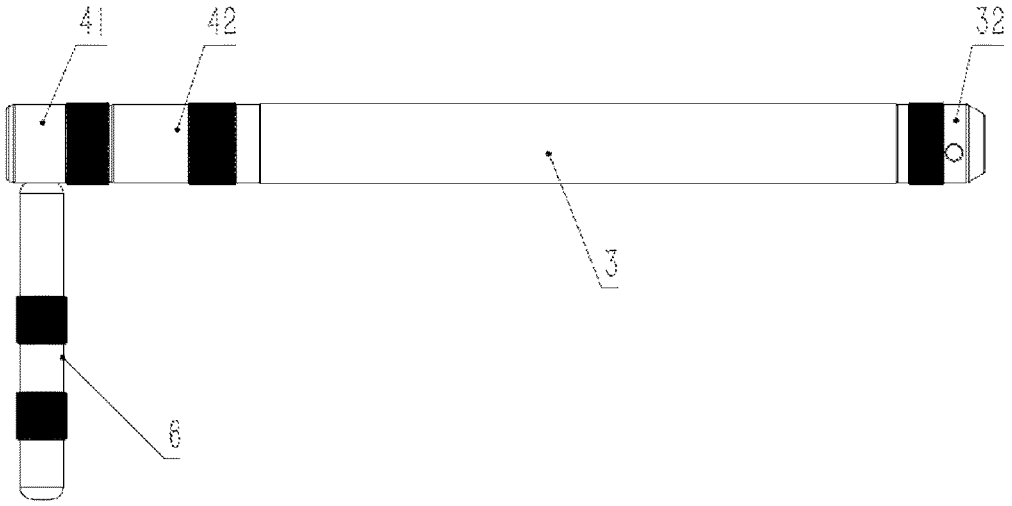
FIG. 18 is a structural schematic diagram of the installation position of the side operating handle in an embodiment of the disclosure herein.

A mounting hole 414 is formed in the cutter bar locking external clamp 41, and the shaft axis of the mounting hole 414 is vertical to the plane in which the second plane 14 is located. When a hook is required during the processing of complex shapes, to facilitate operation, a side operating handle 6 is arranged on the woodworking tool, as shown in FIG. 18, the side operating handle 6 is installed on the installation hole 414 according to the demand of actual operation. In the present embodiment, the side operating handle 6 is installed on the cutter bar locking external clamp 41, thereby ensuring the operating linkage of the cutting head, the planes and the side operating handle. As to the installation mode, a thread fixed connection mode or other modes can be adopted. When a hook is required for processing complex shapes, the side operating handle 6 can be held by another hand to improve the operating stability, and through setting the mounting hole 414, the functions of the woodworking tool are increased.

In order to enhance the comfort of hand feeling, increase friction and improve the performance of safe operation, the connecting long sleeve 3 is sheathed with a rubber cartridge 31, and the connecting long sleeve 3 is internally provided with a counterweight cabin, the counterweight cabin is internally provided with a counterweight block, the tail end of the connecting long sleeve is provided with an end cover 32, and the end cover is provided with threaded holes for installing the counterweight block, so as to achieve the counterweight effect and improve the operation stability.

In the disclosure herein, the structure of the locking piece can also adopt other forms, e.g., the locking piece includes a cutter bar casing and a fastening screw, wherein the cutter bar casing is fixedly connected with the connecting long sleeve, when the cutter bar is replaced, the tail end installation part on the tail end of the cutter bar is inserted into the cutter bar casing, and is fixed via the fastening screw, when the cutter bar is replaced, the fastening screw is twisted off for replacement, and is fixed by rotary twist after the replacement. The locking piece can also be connected by the threads which coordinate with each other, namely, an external thread is arranged on the tail end of the cutter bar, an internal thread is arranged on the front end of the connecting long sleeve, through locking the threaded hole by rotary twist, the cutter bar is connected with the connecting long sleeve, and the locking piece can also adopt other forms, which will not be described in detail herein. The woodworking tool in the disclosure herein adopts such materials as high-speed steel and carbon steel, therefore, the abrasion resistance is favorable and the operating stability is high.

The above embodiments are merely preferred embodiments of the subject matter herein, rather than limiting the disclosure herein in other forms. Those skilled in the art can utilize the technical contents disclosed above to alter or modify the embodiments into equivalent embodiments with equivalent changes to be applied in other fields, however, any simple amendment, equivalent changes or modifications made to the above embodiments based on the technical essence of the disclosure herein without departing from the content of the technical solution in the disclosure herein shall all fall within the protection scope of the technical solution of the disclosure herein.

The invention claimed is:

1. A disposable woodworking tool, comprising:

a cutter bar, wherein a front end of the cutter bar is installed with a cutting head, and a tail end of the cutter bar is installed with a connecting long sleeve; and a locking piece, wherein the locking piece comprises a cutter bar locking external clamp and a cutter bar locking internal clamp which is connected with the cutter bar locking external clamp, and a mounting hole is formed in the cutter bar locking external clamp;

wherein the cutter bar comprises:

a tail end installation part that is fixedly connected with the connecting long sleeve via the locking piece in a detachable manner; and a plurality of planes along a length direction of the cutter bar, and the planes extend to a position, where the cutting head is installed, on the front end of the cutter bar, wherein the planes comprise a first plane, a second plane and a third plane which are connected in sequence, the second plane is in parallel with an upper surface of the cutting head, and an angle formed between the first plane and the second plane as well as an angle formed between the second plane and the third plane are both in a range of 130° to 150°, and a shaft axis of the mounting hole is perpendicular to the second plane.

2. The woodworking tool of claim 1, wherein the tail end installation part is arranged eccentrically to an axis of the cutter bar.

3. The woodworking tool of claim 1, wherein an accommodation cavity for accommodating the tail end installation part is arranged along an axis of the locking piece; the cutter bar locking external clamp comprises a rotary twist part and an external cone, wherein the external cone includes clamping jaws for centering contraction, the cutter bar locking internal clamp comprises a fixed part and an internal cone which coordinates with the external cone, the fixed part being connected with the connecting long sleeve; the rotary twist part is twistable manually to make the external cone be close to the internal cone tightly, and the clamping jaws of the external cone are contracted under the compression from the internal cone, thereby fastening the locking cutter bar.

4. The woodworking tool of claim 3, wherein an outer surface of the locking piece is provided with an anti-slippery part.

5. The woodworking tool of claim 1, wherein a positioning piece for preventing axial rotation of the cutter bar is disposed between the cutter bar and the locking piece.

6. The woodworking tool of claim 5, wherein the positioning piece comprises a locating bulge arranged on the cutter bar and a positioning groove which is arranged on the locking piece and corresponds to the positioning bulge.

7. The woodworking tool of claim 5, wherein the connecting long sleeve is sleeved with a rubber cartridge.

8. The woodworking tool of claim 7, wherein the connecting long sleeve is internally provided with a counterweight cabin, and the tail end of the connecting long sleeve is provided with an end cover.

9. The woodworking tool of claim 1, wherein the cutting head is installed on the front end of the cutter bar via fastening screws.

* * * * *